United States Patent [19]

Dantinne

[11] 4,418,503

[45] Dec. 6, 1983

[54] APPARATUS FOR CONTINUOUSLY POLISHING THE PRESSURE ROLLER OF A COILING MACHINE

[76] Inventor: Pierre G. Dantinne, 6, rue du Coudrier, 4100 Seraing, Belgium

[21] Appl. No.: 215,682

[22] Filed: Dec. 12, 1980

[30] Foreign Application Priority Data

Dec. 27, 1979 [BE] Belgium ..... 198772

[51] Int. Cl.[3] ..... B24B 19/00

[52] U.S. Cl. ..... 51/252

[58] Field of Search ..... 51/252, 253, 262 A, 51/67; 125/11 CS

[56] References Cited

U.S. PATENT DOCUMENTS

| | | | |
|---|---|---|---|
| 588,496 | 8/1897 | Smith | 51/253 UX |
| 1,006,377 | 10/1911 | Bott | 51/253 |
| 1,018,163 | 2/1912 | Cavill | 51/253 |
| 1,634,005 | 6/1927 | Weisgerber | 51/252 |
| 1,677,920 | 7/1928 | Hubbard | 51/262 A |
| 2,589,620 | 3/1952 | Leffel | 51/262 A |

FOREIGN PATENT DOCUMENTS

| | | | |
|---|---|---|---|
| 833538 | 4/1960 | United Kingdom | 125/11 CS |

*Primary Examiner*—Harold D. Whitehead

*Attorney, Agent, or Firm*—Hill, Van Santen, Steadman, Chiara & Simpson

[57] ABSTRACT

An apparatus for the continuous polishing of a pressure roller in a coiling machine, comprising at least one abrasive rubbing element which extends parallel to the axis of rotation of and over the entire length of the face of the roller, the abrasive rubbing element being mounted on a longitudinal support displaceable with respect to the roller parallel to the axis of rotation of the latter, the longitudinal support being mounted to pivot about two coaxial pivots under the action of at least one pneumatic control jack to which it is pivotably connected, the jack being itself articulated on another pivot which is parallel to the two coaxial pivots, thereby to elastically apply the abrasive rubbing element against the face of the roller as the latter rotates in the coiling machine, so as to smooth the roller face and remove any asperities adhering thereto during the winding of a coil, and the longitudinal support being hollow and supplied with cooling water, the support having a pluality of orifices for projecting jets of water onto the face of the roller near the rubbing element and at least upstream of the rubbing element relative to the direction of rotation of the roller.

1 Claim, 3 Drawing Figures

APPARATUS FOR CONTINUOUSLY POLISHING THE PRESSURE ROLLER OF A COILING MACHINE

BACKGROUND OF THE INVENTION

The present invention relates to an apparatus and method for continuously polishing the pressure roller of a coiling machine.

A coiling machine comprises essentially a rotary coiling drum against which the end of a hot-rolled fine strip is applied, and on to which the said strip is wound to form a coil. On entering the coiling machine, the strip is directed towards the coiling drum, by means of two substantially superposed rotary rollers, the upper being a pressure roller exerting a specific pressure on the strip whilst the lower, which is of smaller diameter, is a supporting roller supporting the strip.

In known coiling machines, the pressure roller is not cleaned during operation and more particularly when the beginning of the strip is being wound. Consequently, this roller may carry hard solid particles in a disadvantageous manner on its face. These particles produce relief effects in the upper face of the strip when it is coiled. These effects often result in the corresponding portion of the coil having to be rejected.

SUMMARY OF THE INVENTION

The invention has as its object to allow the aforesaid disadvantage of known coilers to be obviated.

For this purpose, the invention proposes an apparatus and a method whereby the pressure roller is subjected to the action of an abrasive rubbing element capable of polishing its face continuously during its rotational movement, in the course of forming the beginning of the coil. The abrasive rubbing element extends parallel to the axis of rotation of the roller. This rubbing element is applied against the face of the roller during rotational movement in the coiling machine. In this way the abrasive rubbing element smooths the face of the roller and removes therefrom any asperities which may adhere thereto, whilst the strip is in the process of being coiled.

Generally, the abrasive rubbing element extends over the entire length of the roller face in the new apparatus.

In practice, in the new apparatus the abrasive rubbing element is mounted on a longitudinal support displaceable with respect to the roller. Also, the said support pivots about two coaxial pivots under the action of at least one pneumatic control jack to which it is pivotably connected. This jack is itself articulated on another pivot parallel to the first-mentioned pivots. These three pivots are also mounted on the cradle of the pressure roller.

According to an important feature of the new apparatus, the longitudinal support of the abrasive rubbing element is hollow and is supplied with cooling water. This support comprises orifices for projecting jets of water on to the face of the roller near this rubbing element and at least upstream of the latter in relation to the direction of rotation of the roller. Consequently the roller in question is cooled effectively and more especially by the formation of a permanent cushion of water retained against the face of the roller by the abrasive rubbing element. The cooling of the roller prolongs its working life.

To obviate the formation of circular ridges on the face of the pressure roller by the abrasive rubbing element in contact with the said face, it is proposed in the new apparatus and according to the new method that this rubbing element is displaced slightly and in reciprocating manner in a direction parallel to the axis of rotation of the said roller.

To avoid deterioration of the pressure roller being caused by excessive wear of the abrasive rubbing element, the new apparatus comprises a wear detecting device allowing this rubbing element to be withdrawn from the said roller when the said device comes into contact with the latter.

According to a constructional feature of the new apparatus the abrasive rubbing element is formed of a straight row of successive abrasive element segments whose faces in bearing contact against one another and whose end faces of the row are oblique relatively to the longitudinal direction of this row.

In fact the abrasive rubbing element may be constituted in any desired manner. Thus, in a first case, the abrasive rubbing element or each abrasive rubbing element segment as appropriate is constituted by several abrasive sheets which are superposed and clamped against one another in their housing on their support. In a second case, the abrasive rubbing element or each rubbing element segment, as appropriate, is constituted by an abrasive pad.

Other details and features will be brought out during the course of the description and from the drawings attached hereto, which show diagrammatically and simply by way of example one form of embodiment of the invention.

BRIEF DESCRIPTION OF THE DRAWINGS

In these two Figures, like parts are designated by like reference numerals.

DESCRIPTION OF AN EXEMPLARY EMBODIMENT

The apparatus represented serves for the continuous polishing of a pressure roller 1 provided in a manner known per se in a coiling machine. This machine comprises essentially a coiling drum on a fixed frame 2, the said drum having a hot-rolled fine steel strip 3 wound gradually on to it.

Figure 1:
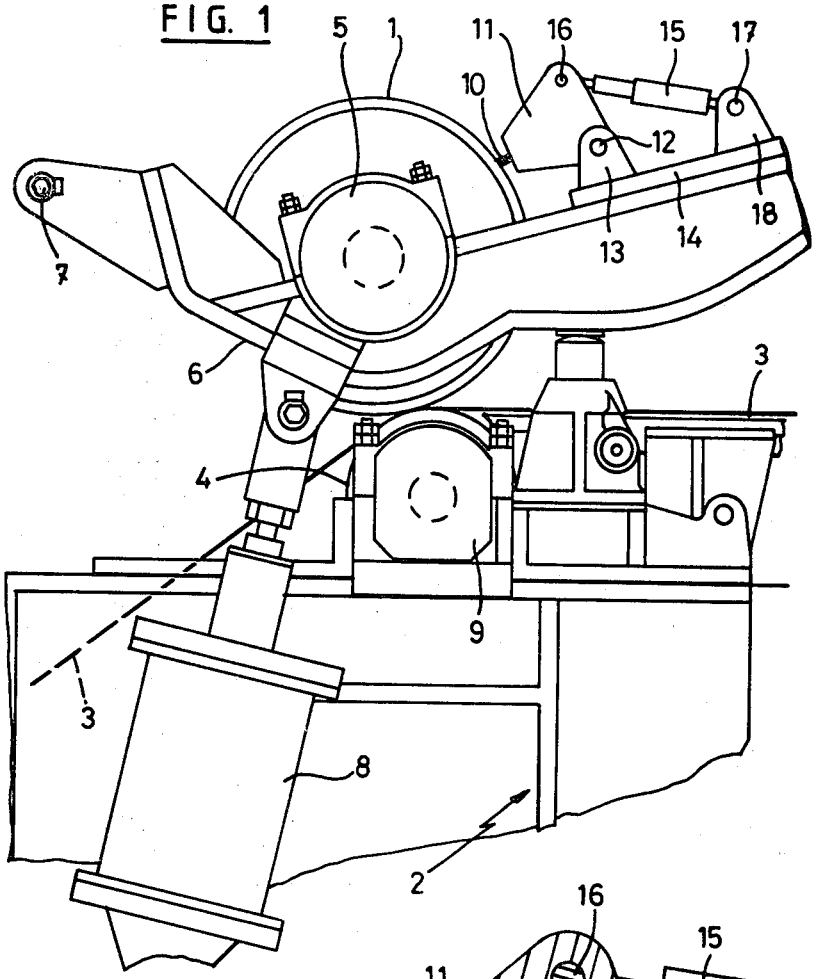
FIG. 1 is a partial view in side elevation of a coiling machine equipped with the new polishing apparatus.

In the coiling machine, the pressure roller 1 co-operates with a supporting roller 4 of smaller diameter which is situated below it. In practice the rollers 1 and 4 are superposed as shown in FIG. 1.

When it enters the coiling machine, the strip 3 passes between the rollers 1 and 4. The roller 1 exerts pressure on the moving strip 3, whilst the roller 4 provides the counter-pressure and serves to support the strip 3. Since the diameter of the roller 1 is larger than that of the roller 4, the strip 3 is downwardly deflected, that is to say towards the coiling drum, as it passes between the two rollers 1 and 4.

It is to be noted that the roller 1 rotates in bearings 5 carried by its supporting cradle 6. This cradle 6 pivots vertically about fixed coaxial pivots 7 of the frame 2 under the action of a hydraulic jack 8. The roller 4 also rotates in bearings 9 carried by the frame 2.

Substantially, the apparatus for continuous polishing of the face of the pressure roller 1 comprises an abrasive rubbing element 10 carried by a longitudinal support 11. The rubbing element 10 and the support 11 extend parallel to the axis of rotation of the roller 1 and over the entire length of the face of this roller 1.

During operation the abrasive rubbing element 10 is applied against the face of the rotating roller 1. The rubbing element 10 therefore acts on the roller 1 during the coiling of the strip 3. The abrasive rubbing element has the effect of smoothing the face of the roller 1 and of removing therefrom the surface asperities and the particles which adhere thereto.

Preferably the abrasive rubbing element 10 is formed of a single straight row of successively arranged abrasive element segments. The faces at which these abrasive element segments abut on one another are oblique relatively to the longitudinal direction of the rubbing element 10. The same applies as regards the end faces of the row. Generally, the abrasive element segments can be constituted by a plurality of abrasive sheets superposed and clamped one against the other in their housing on the support 11 or by an abrasive pad clamped in its housing on this support 11.

The longitudinal support 11, like the abrasive rubbing element 10, is displaceable relatively to the roller 1 whilst remaining constantly parallel to the axis of rotation of this roller 1.

For this purpose the longitudinal support 11 pivots on its ends about two coaxial pivots 12 each carried by lugs 13 fixed to a plate 14 mounted on the cradle 6 at the side opposite from the pivots 7. The rocking of the support 11 is produced by at least one pneumatic jack 15 which applies the rubbing element 10 against the face of the roller 1 with a predetermined elastic pressure.

The jack 15 is connected for pivoting on the one hand about the pivot 16 of one end of the longitudinal support 11, and at the opposite side about another pivot 17 mounted on two lugs 18 fast with the plate 14, this pivot 17 being parallel to the pivots 12 and 16.

In this way, the action of the jack 15 produces movement of the longitudinal support 11 and the abrasive rubbing element 10 towards or away from the roller 1, and therefore makes it possible to apply this rubbing element 10 against the face of this roller 1 during the formation of the coil.

Figure 2:
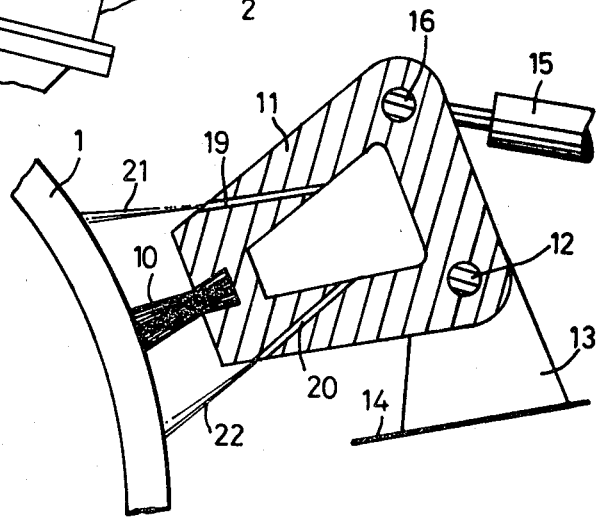
FIG. 2 is a partial cross-sectional view of the polishing apparatus.
Figure 3:
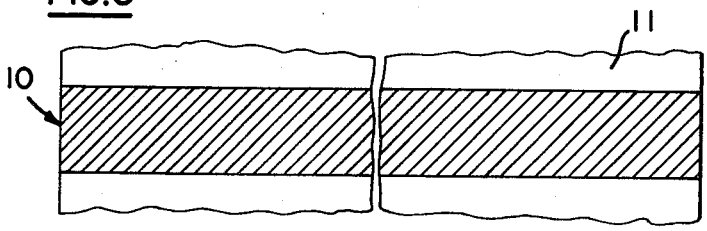
FIG. 3 is a plan view illustrating the abrasive elements.

As FIG. 2 shows, the longitudinal support 11 is hollow and comprises at the two sides of the housing of the abrasive rubbing element 10 two rows of orifices 19 and 20. Also the support 11 is supplied with cooling water under pressure. As a result, two rows of water jets 21 and 22 are projected respectively through the orifices 19 and 20 on to the face of the roller 1 in the vicinity of the zone of contact between the rubbing element 10 and this roller face.

The water jets 21 and 22 cool the roller 1 and more particularly the upper jets 21 since these form a cushion of water retained by the rubbing element 10 and extending over the entire length of the face of the roller.

If required, the polishing apparatus may comprise means capable of displacing the longitudinal support 11 together with the abrasive rubbing element 10 to a slight extent and in reciprocating manner in the axial direction of the roller 1 during the rotational movement of the latter and while the coil is forming. Moreover, this polishing apparatus may comprise a device for detecting wear whereby the abrasive rubbing element 10 can be withdrawn from the roller 1 when this device contacts roller 1.

It will be apparent that the invention is not exclusively limited to the form of embodiment represented here and that many modifications may be made in the form, the disposition and the constitution of some of the components used in its embodiment, provided that these modifications do not contradict the subject of any of the following claims.

What is claimed is:

1. An apparatus for the continuous polishing of a pressure roller in a coiling machine, comprising at least one abrasive rubbing element which extends parallel to the axis of rotation of and over the entire length of the face of the roller, said abrasive rubbing element being mounted on a longitudinal roller, said longitudinal support being mounted to pivot about two coaxial pivots under the action of at least one pneumatic control jack to which it is pivotably connected, said jack being itself articulated on another pivot which is parallel to said two coaxial pivots, thereby to elastically apply the abrasive rubbing element against the face of said roller as the latter rotates in the coiling machine, so as to smooth said roller face and remove any asperities adhering thereto during the winding of a coil, and said longitudinal support being hollow and supplied with cooling water, said support having a plurality of orifices for projecting jets of water onto the face of the roller near the rubbing element and at least upstream of said rubbing element relative to the direction of rotation of the roller, wherein the pivots for the longitudinal support of the abrasive rubbing element and the pivot of the control jack are mounted on the cradle of the roller, wherein the abrasive rubbing element is formed of a straight row of successive abrasive element segments is constituted by a plurality of abrasive sheets which are superposed and clamped against one another in their housing on their support whose faces abut on one another and whose end faces of the row are oblique in relation to the longitudinal direction of said row.

* * * * *